US005546177A

United States Patent [19]

Thayer

[11] Patent Number: 5,546,177

[45] Date of Patent: Aug. 13, 1996

[54] ELECTROSTATIC BRUSH CLEANER PERFORMANCE MONITOR

[75] Inventor: Bruce E. Thayer, Webster, N.Y.

[73] Assignee: Xerox Corporation, Stamford, Conn.

[21] Appl. No.: 524,096

[22] Filed: Sep. 5, 1995

[51] Int. Cl.[6] ..... G03G 21/00

[52] U.S. Cl. ..... 355/301; 355/206

[58] Field of Search ..... 355/203, 205, 355/206, 301, 296; 324/71.1, 452

[56] References Cited

U.S. PATENT DOCUMENTS 5,031,000 7/1991 Pozniakas et al. ..... 355/296 X 5,229,817 7/1993 Lange et al. ..... 355/209

5,400,129 3/1995 Lange et al. ..... 355/301

*Primary Examiner*—Joan H. Pendegrass

*Assistant Examiner*—Sophia S. Chen

*Attorney, Agent, or Firm*—T. L. Fair

[57] ABSTRACT

A method and apparatus for monitoring the performance of a cleaner brush used to clean a photoreceptive surface. The apparatus and method include developing a toner patch of known first length on the imaging surface and then removing that toner patch from the imaging surface using a cleaner brush that accumulates a toner patch of a second length on the surface of the brush. The comparison of the toner patch on the imaging surface versus the toner patch on the brush surface monitor the cleaning efficiency of the cleaner brush.

17 Claims, 5 Drawing Sheets

ELECTROSTATIC BRUSH CLEANER PERFORMANCE MONITOR

BACKGROUND OF THE INVENTION

This invention relates generally to a cleaning apparatus, and more particularly concerns a performance monitor for a brush cleaner.

Electrostatic brush cleaners, like most photoreceptor cleaners, normally have two levels of performance—pass or fail. Subjective attempts to categorize the failures as hard failures or marginal failures have been made, but no indication of how well a cleaner cleans has been available other than counting particles of toner which remained on the photoreceptor after cleaning. Particle counting is extremely tedious and requires a statistical sampling to represent the cleaner performance due to the very low toner densities on the photoreceptor.

Electrostatic brush cleaners typically have soft failure modes. Soft failure modes occur when the performance of the cleaner gradually degrades with time due to various causes of wear. If the cleaner abruptly ceases to function, the causes are normally attributed to catastrophic failures of parts, such as fractures, or loss of bias voltages due to power supply failures or broken wire harnesses. Soft failures can result from normal toner accumulation in the brush which decreases the capacity of the brush to handle high toner input masses. Brush fiber set over time will decrease interference to the photoreceptor, eventually resulting in failures with high toner inputs. Filming of a detoning roll surface or contamination of the brush fiber tips gradually decreases the cleaning capability of an electrostatic brush. Toner or other material becoming impacted on the brush fiber tips or wear of the conductive coating from the tips would also gradually degrade cleaner performance.

The following disclosures may be relevant to various aspects of the present invention and may be briefly summarized as follows:

U.S. Pat. No. 5,229,817 to Lange et al. discloses a cleaning apparatus that includes a rotatable member adapted to contact the charge retentive surface for removing the residual material therefrom, and a motor for rotating the rotatable member. The cleaning apparatus further includes a motor controller for transmitting an electrical signal to the motor, and a machine controller for monitoring the electrical signal to measure the extent of wear to which the rotatable member was subjected. In another aspect of the disclosed embodiment, the cleaning apparatus includes a conductive cleaning member, disposed proximate the charge retentive surface, for generating an electrostatic field to remove the residual material from the charge retentive surface. Additionally, there is provided a power supply for transmitting an electrical signal to the conductive cleaning member, and an electrical circuit for monitoring the electrical signal to measure the extent of wear to which the conductive cleaning member has been subjected.

SUMMARY OF INVENTION

Briefly stated, and in accordance with one aspect of the present invention, there is provided a method for monitoring brush cleaner performance on an imaging surface having a first length of a toner patch thereon, the brush cleaner removing the first length of the toner patch from the imaging surface, comprising: developing the first length of the toner patch of a known length on the imaging surface; removing the first length of the toner patch from the imaging surface with the brush cleaner; accumulating a second length of the toner patch on a surface of the brush cleaner; and measuring the second length of the toner patch on the surface of the brush.

Pursuant to another aspect of the present invention, there is provided an apparatus for monitoring a device for removing a toner patch from an imaging surface, comprising: means for developing a first length of the toner patch on the imaging surface; means for removing the first length of the toner patch from the imaging surface accumulating a second length of the toner patch thereon; means for measuring the second length of the toner patch on the collecting surface; and means for detoning said cleaning device to remove the second length of the toner patch from said removing means to said detoning means.

BRIEF DESCRIPTION OF THE DRAWINGS

Other features of the present invention will become apparent as the following description proceeds and upon reference to the drawings, in which.

Figure 1:
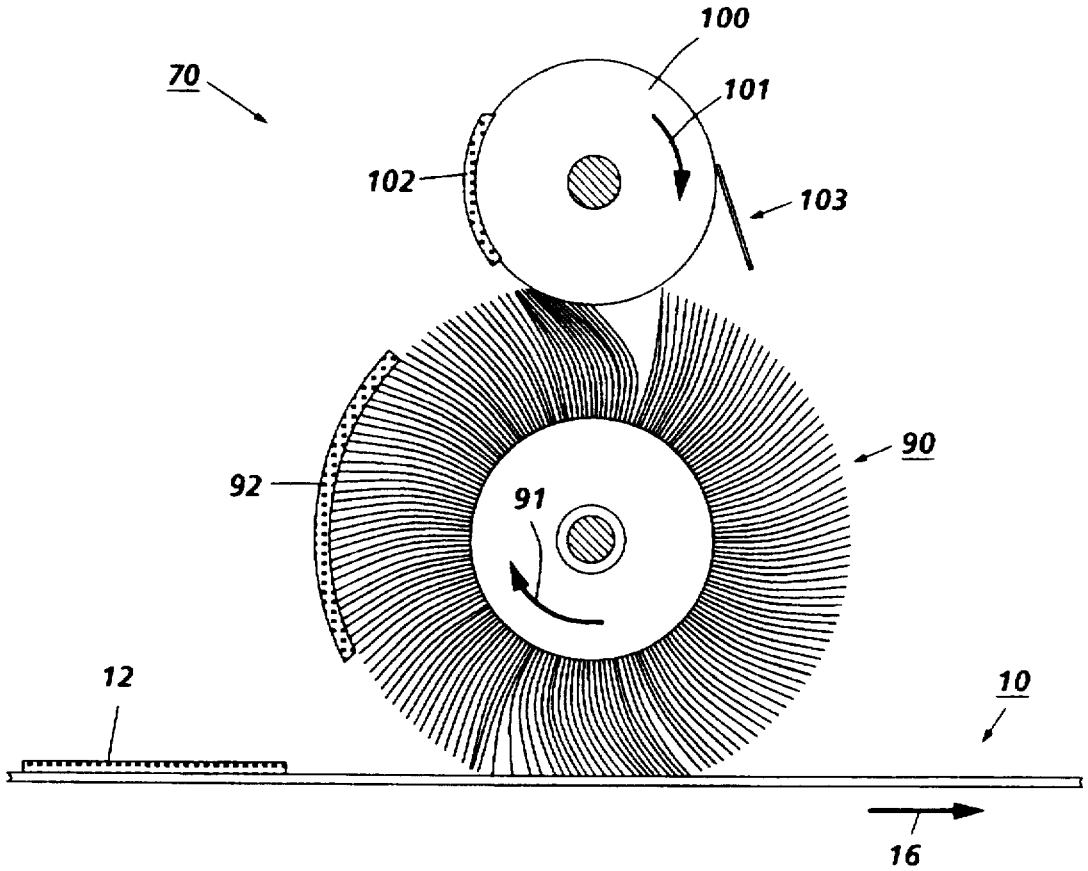
FIG. 1 is a schematic of the electrostatic brush cleaner subsystem showing movement of the toner patch from the photoreceptor, to the cleaner brush to the detoning roll.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same. The various processing stations employed in the reproduction machine illustrated in FIG. 5 will be briefly described.

A reproduction machine, in which the present invention finds advantageous use, utilizes a charge retentive member in the form of a photoconductive belt 10 consisting of a photoconductive surface and an electrically conductive, light transmissive substrate mounted for movement past a charging station A, an exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 18 to advance belt 10 in the direction of arrow 16. Roller 20 is coupled to motor 23 by suitable means such as a belt drive.

Figure 5:
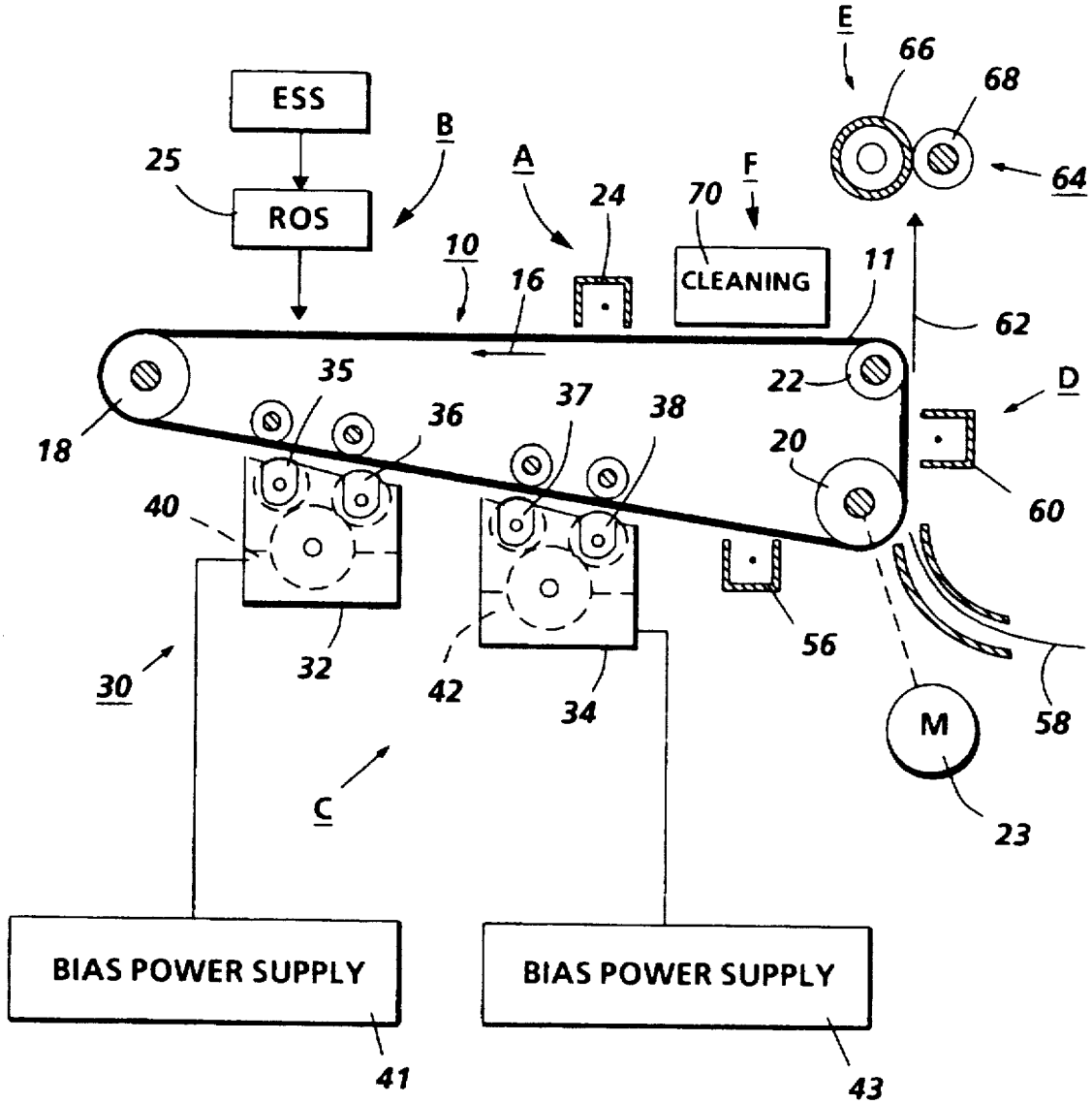
FIG. 5 is a schematic illustration of a printing apparatus incorporating the inventive features of the present invention.

As can be seen by further reference to FIG. 5, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). The resulting photoreceptor contains both charged-area images and discharged-area images.

At development station C, a development system, indicated generally by the reference numeral 30 advances developer materials into contact with the electrostatic latent images, and develops the image. The development system 30, as shown, comprises first and second developer apparatuses 32 and 34. The developer apparatus 32 comprises a housing containing a pair of magnetic brush rollers 35 and 36. The rollers advance developer material 40 into contact with the photoreceptor for developing the discharged-area images. The developer material 40, by way of example, contains negatively charged color toner. Electrical biasing is accomplished via power supply 41 electrically connected to developer apparatus 32. A DC bias is applied to the rollers 35 and 36 via the power supply 41.

The developer apparatus 34 comprises a housing containing a pair of magnetic brush rolls 37 and 38. The rollers advance developer material 42 into contact with the photoreceptor for developing the charged-area images. The developer material 42 by way of example contains positively charged black toner for developing the charged-area images. Appropriate electrical biasing is accomplished via power supply 43 electrically connected to developer apparatus 34. A DC bias is applied to the rollers 37 and 38 via the bias power supply 43.

Because the composite image developed on the photoreceptor consists of both positive and negative toner, a pretransfer corona discharge member 56 is provided to condition the toner for effective transfer to a substrate using corona discharge of a desired polarity, either negative or positive.

Sheets of substrate or support material 58 are advanced to transfer station D from a supply tray, not shown. Sheets are fed from the tray by a sheet feeder, also not shown, and advanced to transfer station D through a corona charging device 60. After transfer, the sheet continues to move in the direction of arrow 62 to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a backup roller 68 with the toner powder images contacting fuser roller 66. In this manner, the toner powder image is permanently affixed to the sheet.

After fusing, copy sheets are directed to catch tray, not shown or a finishing station for binding, stapling, collating etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually.

Residual toner and debris remaining on the surface 11 of the photoreceptor belt 10 after each copy is made, are removed at cleaning station F with a cleaning system 70.

The cleaning efficiency of an electrostatic brush can be characterized by a fiber strikes model. The fiber strikes model converts brush diameter, brush fiber density, brush pile height, photoreceptor speed and brush to photoreceptor interference into the number of fibers expected to contact a single toner particle as it passes through the cleaning nip (i.e. brush contact region to the photoreceptor). By applying the model to conditions along the cleaning failure boundary, the minimum number of fiber strikes to clean the surface can be calculated in the present invention. For example, based upon test data from Xerox machines 5100 and 5090, in order to clean well in all conditions a minimum of eight brush fibers are required to strike a toner particle as it passes under each cleaning brush.

Reference is now made to FIG. 1, which shows a schematic of the electrostatic brush cleaner subsystem and the toner patch movement from the photoreceptor to the detoning roll. The photoreceptor 10 having a toner patch 12 is cleaned by an electrostatic brush cleaner 90. The electrostatic brush cleaner 90, after cleaning the photoreceptor 10, has a toner patch 92 accumulation on the brush surface. The electrostatic detoning roll 100 cleans the toner patch 92 from the brush 90 resulting in the accumulation of the toner patch 102 on the detoning roll 100. This toner patch 102 is then removed from the detoning roll surface by the scraper 103 into an auger (not shown) and/or waste container (not shown). The photoreceptor 10 moves in the direction shown by arrow 16. The electrostatic brush cleaner 90 rotates in a direction shown by arrow 91 and the detoning roll 100 rotates in the direction shown by arrow 101. Time zero detoning efficiency (i.e. the initial detoning efficiency) can be measured by performing a hardstop after two patches 92, 102 have been cleaned from the photoreceptor surface, and then vacuuming toner out of the brush 90 (i.e. Detoning efficiency=Mass of a first patch 102÷Mass of a second patch 92). For "good" cleaning to occur, the mass of the second patch 92 (i.e. toner cleaned from the photoreceptor) equals the mass of a third patch 12 (i.e. toner cleaned and detoned from the brush). During the process of performing time zero detoning efficiency measurements in this manner, the length of the toner patch 92 on the brush 90 before detoning changed as the cleaning conditions were varied. The patch length, varied along with the brush speed as expected, however, surprisingly, significant changes in length were also seen, as parameters such as brush bias, were changed.

For example, as the brush speed increases, the patch length increases, and as the brush speed decreases, the patch length decreases. For a constant nip width, the patch length on the photoreceptor 10 and photoreceptor speed (i.e. the time for the patch to pass through the nip) are constant. If the brush surface speed is slower than the photoreceptor speed, a small arc of the brush contacts the patch 12 on the photoreceptor 10 and the patch 92 on the brush surface is compressed. If the brush surface speed is faster than the photoreceptor speed, a large arc of the brush 90 will clean the patch 12 from the photoreceptor 10 and the patch will be expanded over a larger surface area of the brush due to the increased brush speed. Intuitively, this may have been expected, but in calculating the expected changes in patch length it was found that the distance that the patch travelled through the nip, before being cleaned, was a factor. Recognizing that this distance represents the efficiency of cleaning and that it can be measured is a key element of the present invention. The detoned toner patch 102 on the detoning roll 100 represents the patch removed from the brush 90 after detoning. (Another method of detoning includes air detoning.)

Figure 2A:
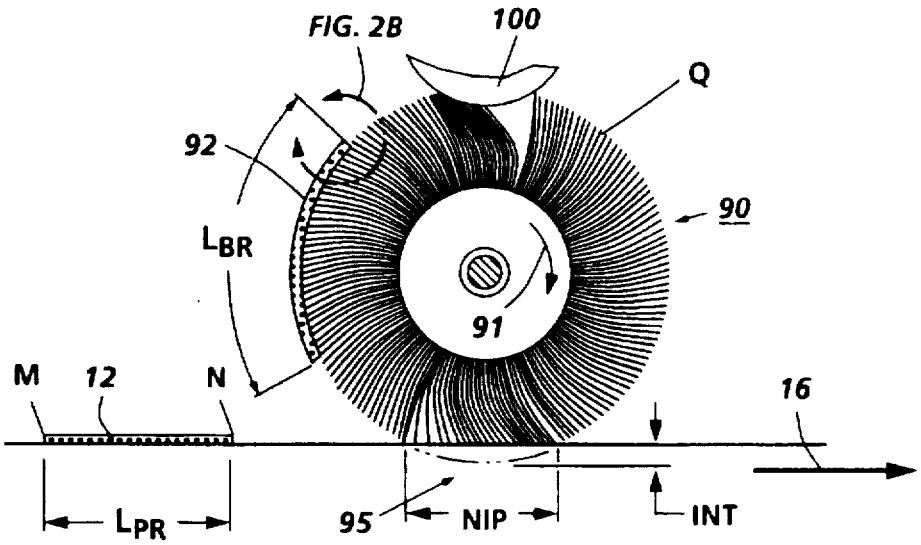
FIG. 2A is a schematic of the brush cleaner showing the parameters for calculating the length of the toner patch on the brush surface of the cleaner brush.
Figure 2B:
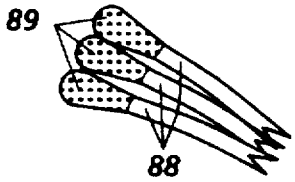
FIG. 2B is an exploded view of FIG. 2A showing toner particles adhering to the brush fibers.
Figure 2C:
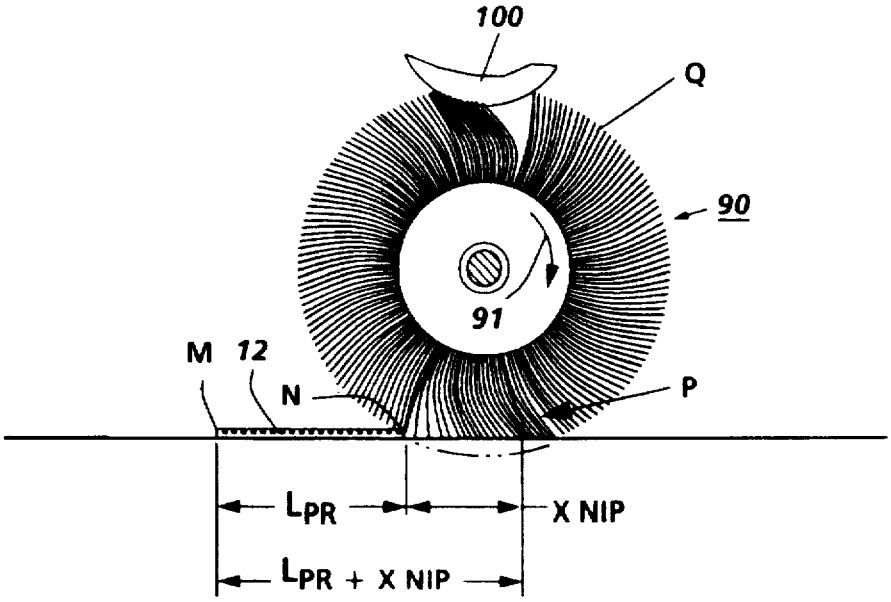
FIG. 2C is a schematic of the cleaner brush which shows the distance the toner patch to be cleaned is from the trail edge of the toner patch to the length of the nip of the brush where cleaning is completed.

Reference is now made to FIGS. 2A and 2C, which show the parameters and calculation of the length of the toner patch on the brush surface. The length of the toner patch on the photoreceptor surface is a known parameter. The expected length of the toner patch on the surface of the brush is then calculated as follows. First, the time it takes for the toner path to be completely cleaned from the photoreceptor 10 is calculated. This is shown in FIG. 2A, as the time it takes from the moment the lead edge, N, of the toner patch 12 enters the cleaning nip 95 until the trail edge of the patch, M, is cleaned from the photoreceptor. For example, in FIG. 2C the reference point P, a distance shown as x NIP, is the point in the nip where the toner patch 12 has been cleaned from the surface. The time is found by dividing the distance the toner patch travels, $L_{PR}$+x NIP, by the speed of the photoreceptor, $V_{PR}$. The length of the toner patch on the brush surface is then just that distance that the brush travels in the time it takes to clean the patch 12 from the photoreceptor 10. The resulting equation is:

$$L_{BR}=N_{BR}\Pi Q\ \{L_{PR}+x\ Q\ \sin\ [\arccos((Q\text{-}2\ INT)/Q)]\}/V_{PR}$$

$L_{BR}$ is the length of the toner patch on (or close to) the surface of the brush. (Note: The toner patch on the surface of the brush is more accurately shown in the exploded view, FIG. 2B, which shows the toner particles 89 adhering to the brush fibers 88 in a match head type configuration.) $N_{BR}$ is the rotational speed of the brush. Πdenotes the ratio of the circumference of a circle to its diameter(i.e. 3.14159265). Q is the diameter of the brush. $L_{PR}$ is the length of the toner patch on the photoreceptor. INT is the level of interference of the brush fibers with the photoreceptor. $V_{PR}$ is the velocity of the photoreceptor in the direction of motion. (It is noted that the equation variables may require conversion factors for the units to properly work out.)

When the length of the cleaned toner patch on the brush is measured in the present invention, the portion, x, of the cleaning nip actually used to clean toner from the photoreceptor, can be calculated. Embodiments of the present invention include measuring the toner patch on the brush surface using sensors such as an electrostatic voltmeter (ESV), capacitive sensor or optical sensor as the brush is rotating. Experimentally an ESV has been successfully used to measure the length of cleaned toner patches on rotating, biased cleaning brushes.

The measurement of the length of the cleaned toner patches on rotating brushes determined in the present invention was verified, experimentally, by performing a hardstop so that the cleaned toner patch 92 is in the same patch position as shown in FIG. 1.

When the portion of the cleaning nip that is actually used to clean toner from the photoreceptor is known, then the number of fiber strikes actually used to clean can be calculated from the total available fiber strikes value. The fiber strikes actually used is the fiber strikes value previously described times the portion, x, of the photoreceptor nip actually used to clean (Fiber Strikes used=x. Total Available Fiber Strikes). Good cleaning conditions can be calculated from cleaned toner patches on an electrostatic brush to as low as from 1 to 2 fiber strikes.

Figure 3:
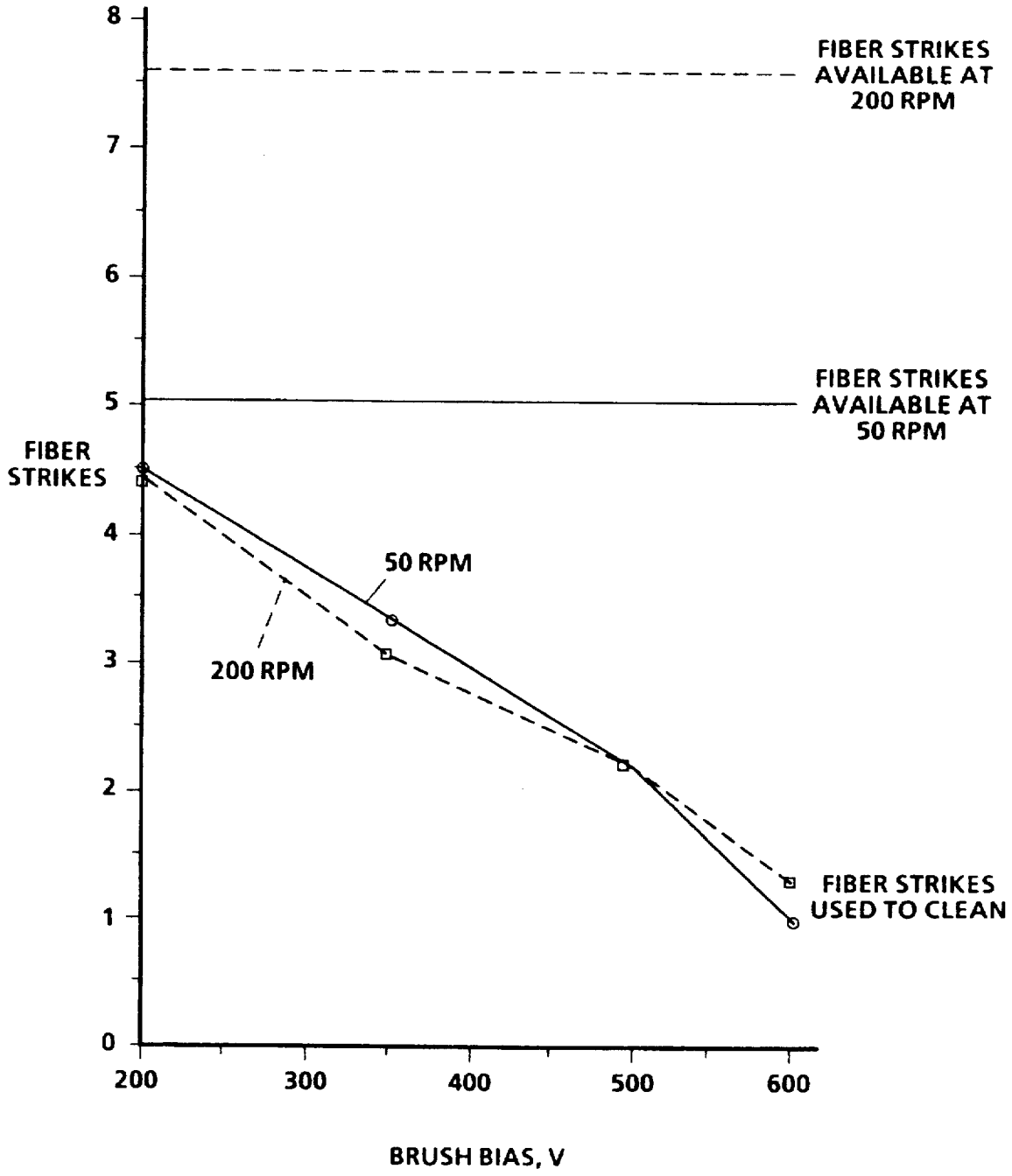
FIG. 3 is a graphical depiction of the fiber strikes used to clean the surface at 50 rpm and 200 rpm.

Reference is now made to FIG. 3, which shows a graphical depiction of the fiber strikes used to clean the surface at 50 rpm and 200 rpm. The data shown in FIG. 3 indicates that the same number of fiber strikes are required to clean toner at 50 rpm and 200 rpm over a range of brush biases. Higher brush biases clean more efficiently and require fewer fiber strikes. Cleaning failures would occur when the fiber strikes required to clean became greater than the fiber strikes available. As shown in FIG. 3, this would be expected to occur at a brush bias of approximately 150 volts for a 50 rpm brush. The 200 rpm brush cleans with the same number of fibers, but earlier in the photoreceptor nip. The 200 rpm brush has more fibers available for cleaning and could be expected to clean a higher stress input or clean longer after brush degradation due to usage. Predictions can be made as to the remaining useful life of the cleaning brush by knowing how many of the available fiber strikes are being used while cleaning is still good. Failure preventive replacement of the cleaning brush can be initiated or cleaning parameters can be changed, such as increasing brush speed or brush bias, to extend brush life.

Mounting a sensor capable of measuring toner patch lengths on the cleaner brush enables measurement of cleaning performance on test fixtures. Use of such a system could greatly increase the amount of information available when performing cleaning latitudes on test machines. Normally information is available to describe the cleaning failure boundary and a marginal cleaning region. By measuring cleaning efficiency as well as cleaning failures more information will be available to describe the robustness of the cleaning latitude. Information will also be available to indicate in good cleaning regions the closeness to a failure boundary. This can improve the efficiency of locating the failure boundary. Another important use of a cleaning efficiency monitor is in designed experiments such as Taguchi testing. It is important in these tests to be able to quantify the quality of cleaning. In the past, cleaning has only been categorized as good, marginal or poor. Using a monitor for efficiency, as in the present invention, cleaning can now be measured on a continuous scale of efficiency. This will greatly improve the information content of test data and result in more productive testing.

By incorporating a sensor to measure a known toner patch, such as a control patch, which is cleaned by a brush cleaner the condition or efficiency of the cleaning process can be monitored through the life of the brush. Preventive maintenance can be initiated or adaptive controls can be used to alter cleaning parameters to avoid cleaning failures. Such a cleaner performance monitor could greatly improve the unscheduled maintenance rate of brush cleaners due to brush set and other usage degradation failure modes. The performance monitor could also be used as a remote sensor to initiate required corrective actions through a RIC (i.e. Remote Interactive Communication) system.

Figure 4A:
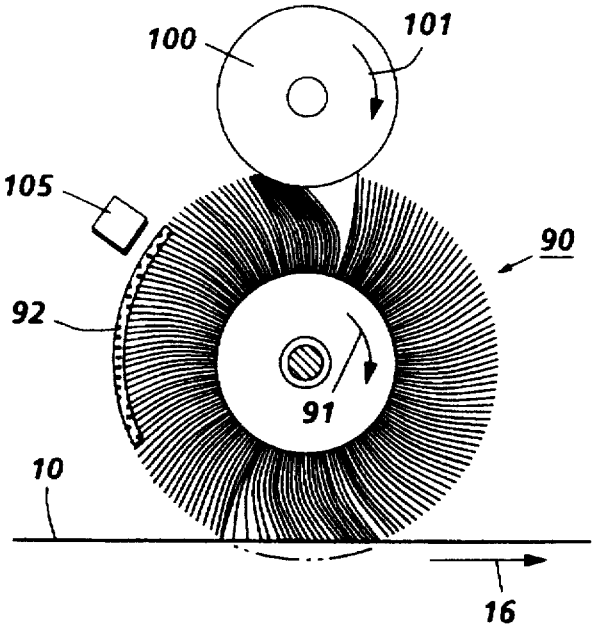
FIG. 4A is a schematic of an electrostatic cleaner with an ESV.
Figure 4B:
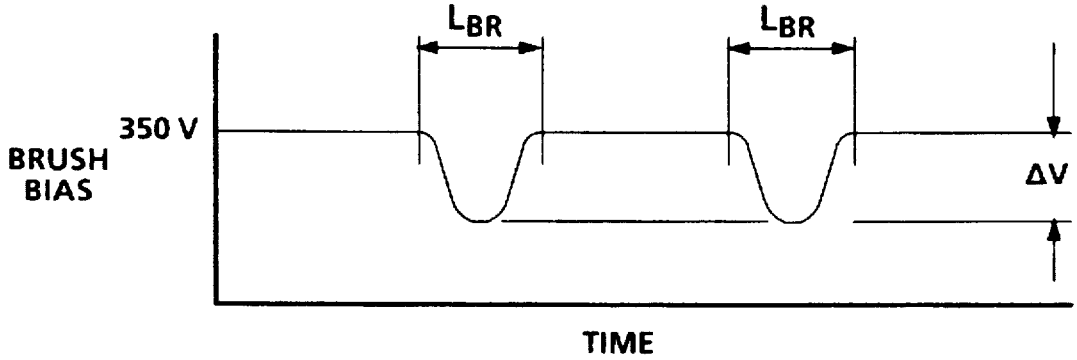
FIG. 4B is a schematic of a typical voltage trace shape showing good cleaning at a bush bias of 350 V.
Figure 4C:
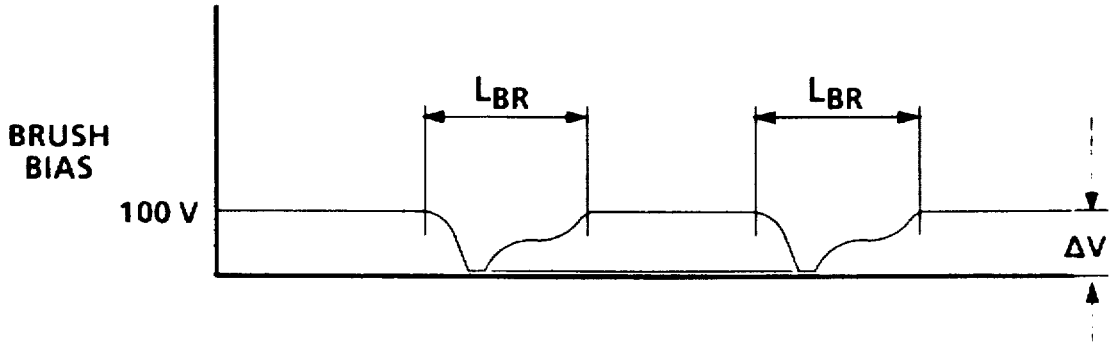
FIG. 4C is a schematic of a typical voltage trace shape for poor cleaning when the brush bias is at 100 V.

Referring now to FIGS. 4A–C, which show the experimental results of locating the ESV relative to the cleaning brush and typical voltage trace shapes. An ESV 105 was mounted as shown in FIG. 4A, closely spaced to the electrostatic cleaning brush 90 in the cleaner subsystem. The output from the ESV 105 was monitored. Referring now to FIGS. 4B and 4C, the brush bias was varied from 100 v to 350 v while measuring the width and magnitude of the voltage drop, ΔV, as the cleaned toner patch passed under the ESV (see FIGS. 4B, 4C). For both high (e.g. about 350 v) and low (e.g. about 100 v) brush biases the voltage change, ΔV, on the brush surface was detectable as the toner passed under the ESV. The length of the toner patch, $L_{BR}$, was also detectable. For high brush biases, (e.g. about 350 v), a short toner patch length (see $L_{BR}$ in FIG. 4B) indicated good cleaning. For low brush biases, (e.g. about 100 v), a longer toner path (see $L_{BR}$ in FIG. 4C) indicated poor cleaning, since all of the brush nip (and the available fiber strikes) was used in cleaning the toner patch.

In recapitulation, the present invention recognizes that the distance the toner patch to be cleaned travels through the brush photoreceptor nip represents the efficiency of cleaning and that this distance can be measured. An embodiment of the present invention utilizes a sensing device to measure the toner patch cleaned by an electrostatic cleaner brush system. This sensing device monitors the efficiency of the cleaning process through the life of the brush. A calculation is performed using toner patch length to determine cleaning efficiency. One toner patch length is known while still present on the photoreceptor, and another toner patch length is then determined when cleaned from the photoreceptor by the brush.

It is, therefore, apparent that there has been provided in accordance with the present invention, a cleaning performance monitor that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A method for monitoring brush cleaner performance on an imaging surface having a first length of a toner patch thereon, the brush cleaner removing the first length of the toner patch from the imaging surface, comprising:

developing the first length of the toner patch of a known length on the imaging surface;

removing the first length of the toner patch from the imaging surface with the brush cleaner;

accumulating a second length of the toner patch on a brush cleaner surface; and measuring the second length of the toner patch on the brush cleaner surface.

2. A method as recited in claim 1, further comprising the step of comparing the second length of the toner patch to the first length of the toner patch for determining cleaning efficiency from the difference between the first length of the toner patch and the second length of the toner patch.

3. A method as recited in claim 2, wherein the removing step comprises the step of moving the surface having the first length of the toner patch thereon into a brush-imaging surface nip where the brush cleaner and the imaging surface are in contact.

4. A method as recited in claim 3, further comprising the step of determining the distance into the brush-imaging surface nip required to remove the first length of the toner patch from the imaging surface.

5. An apparatus for monitoring a device for removing a toner patch from an imaging surface, comprising:

means for developing a first length of the toner patch on the imaging surface;

means for removing the first length of the toner patch from the imaging surface accumulating a second length of the toner patch thereon;

means for measuring the second length of the toner patch on the collecting surface; and means for detoning said cleaning device to remove the second length of the toner patch from said removing means to said detoning means.

6. An apparatus as recited in claim 5, wherein said removing means comprises a cleaning brush.

7. An apparatus as recited in claim 6, wherein said cleaning brush comprises a brush surface for collecting the second length of the toner patch thereon from the first length of the toner patch removed from the imaging surface.

8. An apparatus as recited in claim 7, wherein said measuring means comprises a device responsive to the first toner patch exceeding a preselected value, for indicating potential failure of said brush.

9. An apparatus as recited in claim 7, wherein said measuring means comprises an electrostatic voltmeter to determine length of the second length of the toner patch on the brush surface.

10. An apparatus as recited in claim 9, wherein the imaging surface being adjacent to said cleaning brush comprises a brush-imaging surface nip over a distance where said cleaning brush contacts said imaging surface.

11. An apparatus as recited in claim 10, wherein the second length of the brush, $L_{BR}$, being determined by an equation of $$L_{BR}=N_{BR}\Pi Q\{L_{PR}+x\ Q\ \sin\ [\arccos((Q\text{-}2\ INT)/Q)]\}/V_{PR}$$

where $N_{BR}$ is a rotational speed of said cleaning brush, D is a diameter of said cleaning brush, $L_{PR}$ is the length of the imaging surface, x is the distance the first length of the toner patch travels into the brush-imaging nip, INT is interference between the imaging surface and said cleaning brush in the brush-imaging surface nip and, $V_{PR}$ is a speed of the imaging surface.

12. An apparatus as recited in claim 11, further comprising means for comparing the second length of the toner patch to the first length of the toner patch for determining cleaning efficiency.

13. An apparatus as recited in claim 12, wherein said detoning means comprises a detoning roll.

14. An apparatus as recited in claim 12, wherein said detoning means comprises air detoning.

15. An apparatus as recited in claim 13, further comprising means for determining the distance the first length of the toner patch travels into the brush-imaging nip to be removed from the imaging surface.

16. An apparatus as recited in claim 15, wherein said cleaning brush comprises a direction of movement.

17. An apparatus as recited in claim 16, wherein the second length of the toner patch varies according to a speed of said cleaning brush in the direction of movement.

* * * * *